US005676123A

United States Patent [19]

McPherson

[11] Patent Number: 5,676,123

[45] Date of Patent: Oct. 14, 1997

[54] CLOCKWISE AND COUNTER CLOCKWISE COMBINATION STRANDED BOW STRING

[76] Inventor: Mathew A. McPherson, P.O. Box 633, Austin, Minn. 55912

[21] Appl. No.: 306,667

[22] Filed: Sep. 15, 1994

[51] Int. Cl.[6] ..... F41B 5/14

[52] U.S. Cl. ..... 124/90; 57/204; 57/237

[58] Field of Search ..... 57/200, 204, 236, 57/237; 124/23.1, 25.6, 86, 87, 90, 91, 92; 33/265

[56] References Cited

U.S. PATENT DOCUMENTS

| | | | |
|---|---|---|---|
| 2,986,867 | 6/1961 | Berry | 57/204 X |
| 3,703,771 | 11/1972 | Saunders | 33/265 |
| 4,011,853 | 3/1977 | Fletcher | 124/87 |
| 4,644,989 | 2/1987 | Charvet et al. | 57/236 X |
| 4,656,994 | 4/1987 | Jenks | 124/87 X |
| 4,934,332 | 6/1990 | Scherz | 124/87 |
| 5,056,498 | 10/1991 | Scherz | 124/87 |
| 5,092,308 | 3/1992 | Sheffield | 124/25 |
| 5,333,442 | 8/1994 | Berger | 57/236 X |

FOREIGN PATENT DOCUMENTS

| | | | |
|---|---|---|---|
| 1812256 | 4/1993 | U.S.S.R. | 57/237 |

OTHER PUBLICATIONS

Partial brochure picture from Archery Visions.

Partial brochure picture from Precision Shooting Equipment, Inc.

"For '94 The Best Just Got Better", from API Outdoors Inc.

"He Is Our Future" from Darton Archery Visions.

"Hunting Bow" picture from *Bowhunting*, Sep. 1994.

Partial Catalog for "Peep Sights", pp. 25–26.

*Primary Examiner*—John A. Ricci

*Attorney, Agent, or Firm*—Vidas, Arrett & Steinkraus, P.A.

[57] ABSTRACT

A bow string having a plurality of parallel strands, comprising at least one first strand being twisted in a clockwise manner, and at least one second strand being twisted in a counter clockwise manner, wherein the amount of twists in the second strands are the same as that of the first strands, and wherein the number of first strands approximately equals the number of second strands.

11 Claims, 3 Drawing Sheets

CLOCKWISE AND COUNTER CLOCKWISE COMBINATION STRANDED BOW STRING

FIELD OF THE INVENTION

This invention generally relates to an archery bow string, and more specifically to an improved bow string that is designed to prevent a conventional peep sight from rotating out of alignment when the bow string is drawn or when the bow string itself distorts due to aging or normal wear and tear.

BACKGROUND OF THE INVENTION

Today's archers generally fire compound bows, recurved bows, long bows or combinations of compounded re-curved bows using mechanical releases and different types of sighting devices. This advance technology adds considerably to the accuracy and can be achieved by hunters and target shooters alike. The prior art is replete with devices which have sought to improve archery techniques. In the construction of archery bows, it is customary to equip the bow string with both a nocking point and a peep sight spaced a pre-determined distance on the bow string above the nocking point. In the construction of bows described in the prior art, it is conventional to attach the peep sight to the bow string in spaced relation above the nocking point so as to be in the line of sight of the archer. A peep sight is usually a disk having a sighting hole or peep and mounted between the strands of the multistranded bow string. The peep sights are typically affixed to the bow string by separating the strands of the bow string and inserting them into external grooves or channels which are formed along the periphery of and in the central plane of the peep sight. This construction ensures that the peep sight will be snugly positioned within and along the central axis of the bow string.

It is convenient for an archer to be able to sight his shot using an archer bow peep sight. Commonly, such peep sights are attached in some manner to the archery bow string. When the string is drawn, the archer sights his target by looking through the peep to a sighting mechanism, such as a pin or crosshair sight, mounted on the bow handle and then to the target. An example of such an archery peep sight is the MONSTER (trademark) hunting peep manufactured by Gormons Design of Minneapolis, Minn. Other types of vertical mounted peep sights are the No-Sir Hunting Peep manufactured by Golden Key Ventura, Montrose, Colo. and the peep sight disclosed in U.S. Pat. No. 3,703,771. A problem exists with the prior art mounted peep sights in that when the bow string is drawn, the peep sight is rotated slightly to the left or to the right. This is due to the fact that the bow strings are made of a plurality of strands and those strands are exclusively twisted in either a clockwise or counter clockwise manner. As the bow string is drawn, the increasing tension on the twisted bow string causes the string to rotate slightly which in turn rotates the peep sight and thus moves it out of alignment with the target or creates a reflection or glare because of the rotated peep sight.

Another problem that arises while using a conventional peep sight with a conventional bow string is that a reflection or glare is created as a result of the slight rotation. The reflection or glare makes it difficult to see through the peep sight and therefore makes it extremely hard to align the arrow with the target. Twisting or misalignment of the sight opening in a rotational direction about the axis of the bow string creates misalignment with respect to the sight of the archer as well as obstructive reflection and glare.

Keeping the sight aligned so that the archer can view the front sight has long been a problem in the art. The string can, with usage and resetting, become twisted thus causing misalignment of the peep sight. Re-aligning the sight is generally a tedious and sometimes fruitless task. Seldom is it possible to get the peep perfectly aligned because the string will turn or twist each time the bow is broken down as, for example, when it is stored or being transported. Invariably when the bow is again set-up, the peep will be out of alignment and a good deal of time is wasted getting it re-adjusted.

One of the root causes of these sight problem is the manner in which the bow string is made. Conventional bow strings are made of a plurality of strands, which in turn may be made from a variety of materials well known in the art. These strands are grouped together in parallel fashion being careful not to twist or otherwise disturb the parallel alignment of the strands. Each individual strand is twisted exclusively in either a clockwise or counter clockwise direction before being grouped together and bound using conventional serving. The problem lies in the fact that all the strands of a conventional bow string are either twisted in a clockwise or counter clockwise direction. This singularity of direction has a tendency to cause the bow string to rotate either right or left and thus rotate the peep sight. This rotational distortion also happens during normal wear and tear or aging. The string degrades and distorts in such a way as to rotate the whole bow string creating the constant need to realign the installed peep sight.

One of the devices in the prior art that attempts to solve the problem of peep sight misalignment is a peep-sight alignment device. Examples of such a device are "Line O Peep" sold by Golden Key or Peep Aligner sold by Arrowzona. These devices consist of a rubber tubing which attaches securely to the bow string or peep and to either the cable or the upper arm of the bow itself. When the string is drawn the tubing stretches to a taught position and draws the string, and thus the peep sight, into alignment. This method calls for an additional piece of improvement device that requires attachment and calibration before use, and can have a negative effect because of the interference with the natural thrust of the string. Even after time the alignment device can be twisted out of alignment requiring recalibration.

SUMMARY OF THE INVENTION

This invention generally relates to an archery bow string, more specifically to an improved bow string that is designed to prevent a conventional peep sight from rotating out of alignment when the bow string is drawn or when the bow string itself distorts due to aging or normal wear and tear.

The improvement relates to the making of a bow string. Bow strings are generally made from a plurality of parallel strands, the strands being bound together without compromising their parallel relationship. While conventional bow strings are made by twisting each strand in one direction before binding them together, the present invention utilizes a method wherein approximately half the strands are twisted in a clockwise fashion and approximately half are twisted in a counter clockwise fashion. The method creates counter-balancing forces on the peep sight preventing rotational distortion, and thus prevents misalignment of the peep sight. In its purest form, half of the strands are twisted in the clockwise direction and half are twisted in the counter clockwise direction, but due to the fact that the main body of the bow string itself may be slightly twisted intentionally or unintentionally it may be necessary to have a few more strands twisted in one direction than the other.

It is an object of this invention to provide an easy method to prevent misalignment of an archery bow peep sight.

It is another object of the present invention to provide an archery bow string that cures the problem of peep sight rotation which is inexpensive and simple to fabricate.

It is still another object of the invention to remove the need of using additional peep aligning devices such as the Peep Aligner or "Line O Peep" as mentioned above.

DETAILED DESCRIPTION OF THE INVENTION

Figure 1:
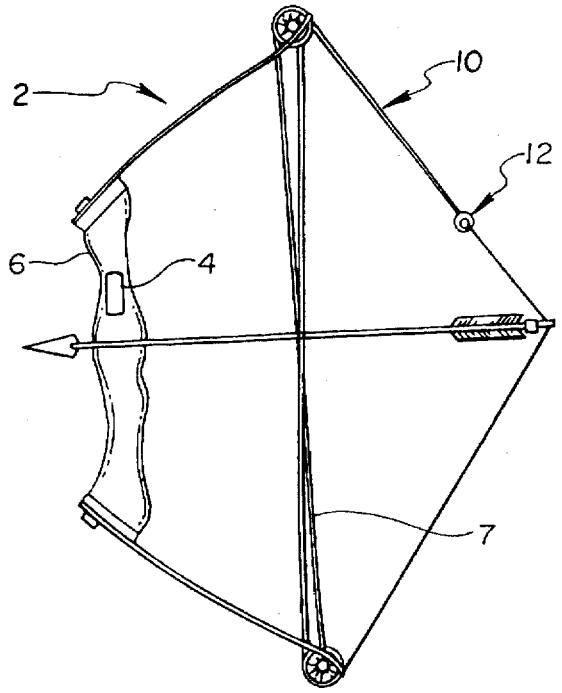
FIG. 1 shows a side view of a conventional bow.

Turning initially to FIG. 1, there is shown a compound bow, generally referenced 2, that includes the bow string making system of the present invention. The problem that is solved by the present invention arises when the bow string, generally designated 10, is drawn causing the installed peep sight, generally designated 12, to rotate out of alignment as simulated in FIG. 1. The peep sight 22 is mounted upon the bow string 10 which in turn is mounted on a conventional bow 2. When positioned correctly the peep sight coacts and axially aligns with reference to the front sight 4.

This misalignment problem is caused by the fact that all the strands of conventional bowstrings are twisted in the same direction, that being either clockwise or counterclockwise. This tends to distort the bow string when drawn, rotating the bow string slightly and thus rotating the installed peep sight 12. The present invention solves this by twisting about half of the strands counter clockwise and about half the strands clockwise before combining all the strands into the completed bow string. This method of making a bow string has the effect of counteracting the rotational tendency in the bowstring, which rotates the peep sight out of alignment, by creating an equal and opposite tendency in the bow string to prevent misalignment of the peep sight.

Figure 2:
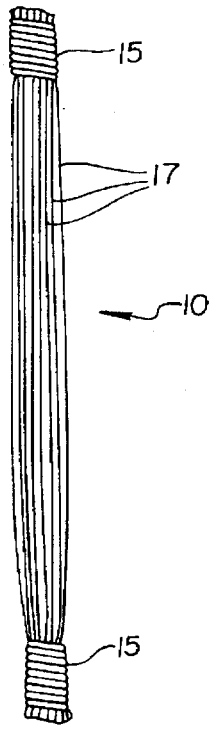
FIG. 2 shows a sectional view of a bow string.

The bow string 10 of the present invention is made up of a plurality of strands 17 as shown in FIG. 2. Each individual strand is twisted a predetermined amount of times in an either clockwise or counter clockwise direction, an approximately equal amount of strands being twisted in both directions. The individual strands are twisted approximately 2–5 times per inch. After the strands are individually twisted and grouped together to create the bow string, they are bound in place to prevent unravelling. This may be done through the use of a conventional serving to create windings 15 at strategic places along the bow string. Care must be taken not to twist or otherwise disturb the parallel alignment of the individual strands making up the bow string, otherwise the purpose of the opposing twisting method would be defeated.

Figure 3:
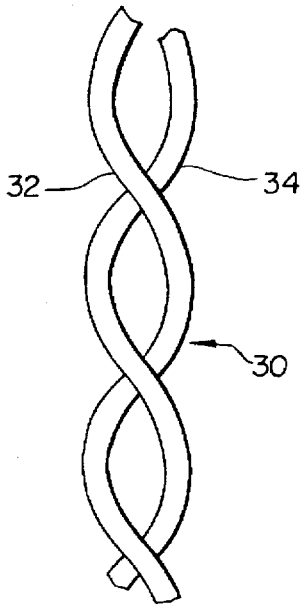
FIG. 3 shows an exploded view of a strand of the Type 1 embodiment twisted in a clockwise direction.
Figure 4:
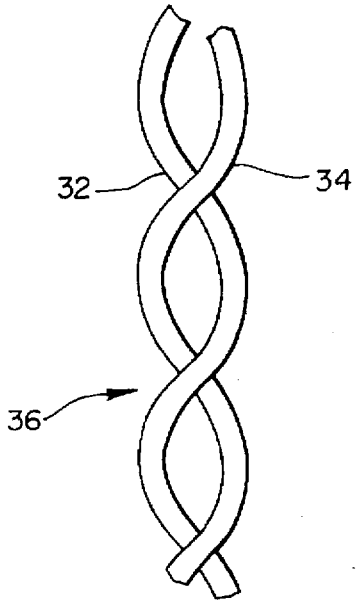
FIG. 4 shows an exploded view of a strand of the Type 1 embodiment twisted in a counter clockwise direction.
Figure 5:
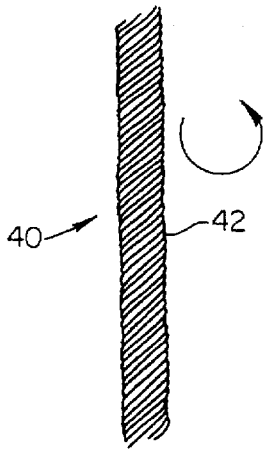
FIG. 5 shows a sectional view of a strand of the Type 2 embodiment twisted in a counter clockwise direction.
Figure 6:
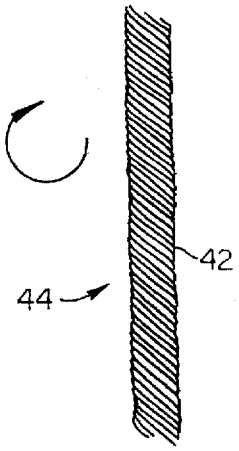
FIG. 6 shows a sectional view of a strand of the Type 2 embodiment twisted in a clockwise direction.

The strands of the bow string can be made in two different ways. The first method would be to make the strands using two or more strings, which are made of micro-fibers, as shown in FIGS. 3 & 4. The second method would be to make the strands directly out of micro fibers as shown in FIGS. 5 & 6. In either method the bow string is made from an approximately equal number of strands twisted in both a clockwise direction and a counter clockwise direction. Any conventional type of material used in the archery industry may be used in the present invention.

Figure 8:
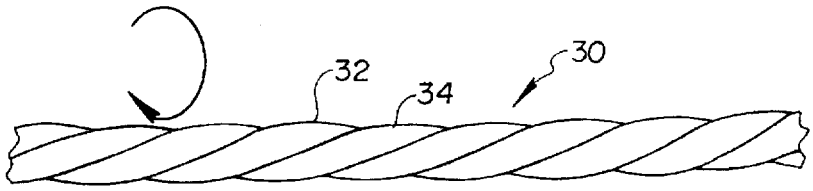
FIG. 8 shows a sectional view of a strand of the Type 1 embodiment twisted in a clockwise direction.
Figure 7:
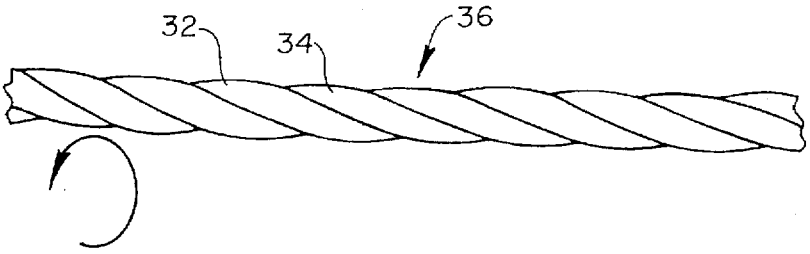
FIG. 7 shows a sectional view of a strand of the Type 1 embodiment twisted in a counter clockwise direction.

The first method of creating a strand is depicted in FIGS. 3,4,7 & 8. FIG. 7 shows a strand, generally designated 36, comprised of two strings 32 & 34, which in turn are made from micro-fibers, as is well known in the art. The strings 32 & 34 are twisted individually and about each other in a counter clockwise direction, eventually forming an individual strand. For every strand 36 made, one strand, as shown in FIG. 8, generally designated 30, must be made to balance the bow string. FIG. 8 shows a strand 30, comprised of two strings 32 & 34, which in turn are made from micro-fibers. The strings 32 & 34 are twisted individually and about each other in a clockwise direction, eventually forming an individual strand. FIGS. 3 and 4 illustrate strands 30 & 36 in a loose position to demonstrate the opposing twisting method. FIG. 3 demonstrates two strings 32 & 34 being twisted in a clockwise direction to form strand 30 and FIG. 4 demonstrates two strings 32 & 34 being twisted in a counter clockwise direction to form another strand.

The second method used in making individual strands would be to make the strands directly out of micro fibers as shown in FIGS. 5 & 6. The bow string is made from an approximately equal number of strands twisted in both a clockwise direction and a counter clockwise direction. FIG. 5 shows a strand, generally designated 40, comprised of micro-fibers. The strand 40 is twisted in a counter clockwise direction for a predetermined number of twists, eventually forming an individual strand. FIG. 6 shows a strand, generally designated 44, also comprised of micro-fibers. The strand 44 is twisted in a clockwise direction for a predetermined number of twists, eventually forming another individual strand. For every strand 40 made, another strand 44 must be made to balance the bow string.

The main bow string itself may, and usually does, twist during the process of making and mounting it on the bow. Due to these additional twists, the number strands twisted in one particular direction may be greater to offset the additional twists in the bow string as a whole. The number of strands in either direction becomes less critical when the total number of strands increases. As the total number increases the difference between the number of clockwise and counter clockwise turned strands becomes a smaller percentage of the overall number of strands. With the increase of the total number of strands the ratio of the clockwise to the counter clockwise turned strands approaches one, and therefore the effect that the difference in the number of each particular strands has on the bow string as a whole becomes more insignificant. As long as the number of strands twisted in each particular direction is approximately equal, the peep sight will remain aligned.

Figure 9:
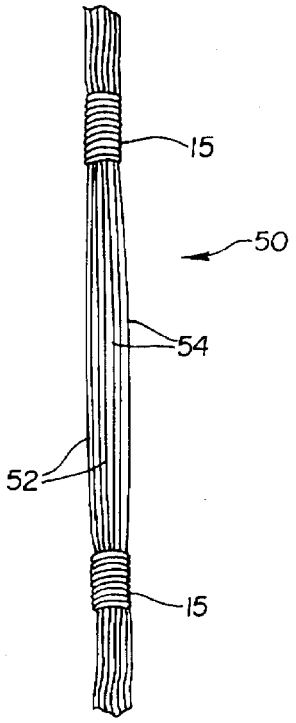
FIG. 9 shows a sectional view of a mixed strand bowstring.

The finished strands of both of the above mentioned bow string making methods can be grouped together to create a bow string in two different grouping methods. The first grouping method as shown in FIG. 9, generally designated 50, entails grouping all of the strands in a parallel fashion randomly. The clockwise twisted strands 54 and the counter clockwise twisted strands 52 are intermixed so that both types of strands are equally dispersed throughout the bow string 50.

Figure 10:
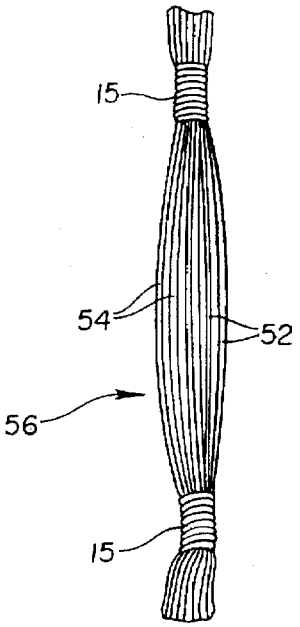
FIG. 10 shows a sectional view of a grouped strand bowstring.

The second grouping method as shown in FIG. 10, generally designated 56, entails grouping all of the strands in a parallel fashion in two separate groups. The clockwise twisted strands 54 and the counter clockwise twisted strands 52 are grouped separately first to form a grouping of clockwise twisted strands 54 and a separate grouping of counter clockwise strands 52. These two groupings are then bound together in a parallel fashion without intermixing. In both grouping methods there must be a strand 52 for every strand 54 to balance the bow string.

Figure 11:
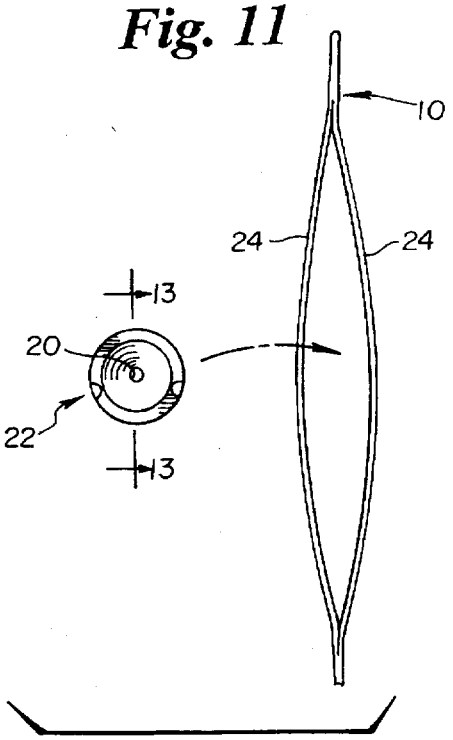
FIG. 11 shows a exploded view of a peep sight insertion into a bowstring.
Figure 12:
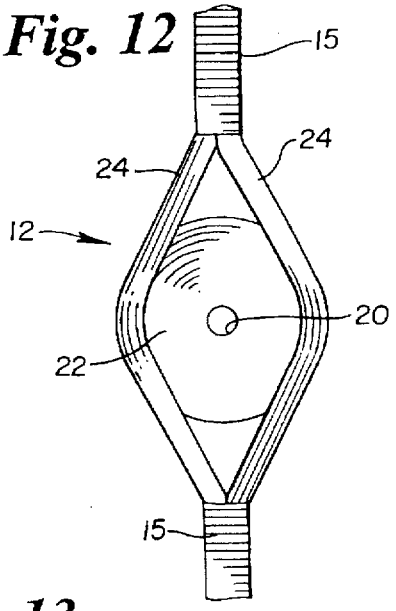
FIG. 12 shows a peep sight inserted into a bowstring.
Figure 13:
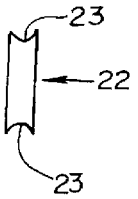
FIG. 13 shows a sectional view of an installed peep sight.

The purpose for incorporating this opposing twisting method is to prevent the peep sight from rotating out of alignment due to the distortion in the bow string when it is drawn or the break down of the bow string because of normal wear and tear. The installed peep sight 12 is attached to the opposite or upper end of the string as viewed in FIG. 1. FIGS. 11 & 12 demonstrate the insertion of the peep sight into the bow string. The peep sight, generally designated 22, with a peeplet 20 is a rear sight that is usually mounted upon the bow string 10. The peep cooperates with front sight 4 affixed to the bow handle 6. The peep sight is provided with a peripheral groove 23 for receiving string strands 24 therein. The sight is mounted by separating the strands as depicted in FIG. 11 at a predetermined position with an approximately equal number of strands 24 of the bow string 10 passing on either side of the sight 22. After the peep sight is mounted, it can be secured by several methods, one of which would be to use conventional serving 15 as shown in FIG. 12. The strands may be organized in a manner in which all the clockwise twisted strands are on one side of the peep sight and all the counter clockwise twisted strands are on the other, or in a manner in which about half of the clockwise twisted strands and about half of the counter clockwise twisted strands are on one side and the other half each type of strand is on the other.

Keeping the sight aligned so that the archer can view the front sight has been accomplished in the past by either using more complicated adjustable peep sights or by using rubber alignment cords. The present invention alters the bow string itself curing the cause of the problem, thus removing the need to add additional or more costly materials. The opposing twisting method creates equal counteracting forces allowing the bow string maintain alignment during the drawing process or to degrade uniformly during the aging process.

While this invention may be embodied in many different forms, there are described in detail herein specific preferred embodiments of the invention. This description is an exemplification of the principles of the invention and is not intended to limit the invention to the particular embodiments illustrated. All these alternatives and variations are intended to be included within the scope of the attached claims. Those familiar with the art may recognize other equivalents to the specific embodiments described herein which equivalents are also intended to be encompassed by the claims attached hereto.

What is claimed is as follows:

1. A bow string having a plurality of parallel strands, which comprises:

a plurality of first strands, each first strand being twisted in a clockwise manner; and a plurality of second strands, each second strand being twisted in a counter clockwise manner, wherein the amount of twists is approximately the same as that of the first strands, wherein the number of first strands approximately equals the number of second strands, and wherein each first strand comprises a plurality of micro fibers and each second strand comprises a plurality of micro fibers.

2. The bow string of claim 1, wherein the first strands and the second strands are intermixed in a random manner with respect to each other.

3. The bow string of claim 1, wherein the first strands and the second strands are grouped separately and are not intermixed with respect to each other.

4. A bow string having a plurality of parallel strands, which comprises:

a plurality of first strands, each first strand being twisted in a clockwise manner, wherein the first strands comprise a plurality of first strings, the first strings being twisted in a clockwise manner; and a plurality of second strands, each second strand being twisted in a counter clockwise manner, wherein the amount of twists in the second strands is approximately the same as that of the first strands, wherein the second strands comprise a plurality of second strings, the second strings being twisted in a counter clockwise manner, wherein the number of first strands approximately equals the number of second strands and the number of first strings approximately equals the number of second strings, and wherein each first string comprises a plurality of micro fibers and each second string comprises a plurality of micro fibers.

5. The bow string of claim 4, wherein the first strands and the second strands are intermixed in a random manner with respect to each other.

6. The bow string of claim 4, wherein the first strands and the second strands are grouped separately and are not intermixed with respect to each other.

7. A bow string of the type having a plurality of parallel twisted strands and a peep sight, the improvement comprising:

twisting each of ½ of the plurality of strands in the clockwise direction; and twisting each of the other ½ of the plurality of strands in the counter clockwise direction, whereby the forces exerted by the strands on the peep sight over time cancel out to prevent misalignment of the peep sight.

8. The bow string of claim 7 wherein the peep sight has a peripheral channel and is secured to the bowstring with ½ of the strands on each side of the peep sight's channel.

9. The bow string of claim 8 wherein all the clockwise twisted strands are on one side of the peep sight and all the counter clockwise twisted strands are on the other side of the peep sight.

10. The bow string of claim 8 wherein ½ of the clockwise twisted strands and ½ of the counter clockwise twisted strands are on one side of the peep sight, and the other ½ of the clockwise twisted strands and the other ½ of the counter clockwise twisted strands are on the other side of the peep sight.

11. A method of making a bowstring comprising the steps:

supplying a plurality of strands;

twisting ½ of the strands in a clockwise direction;

twisting the other ½ of the strands in a counter clockwise direction, twisting the same amount of times as the strands twisted in the clockwise direction;

binding all of the clockwise twisted strands together in a parallel fashion to create a first group and all the counter clockwise twisted strands together in a parallel fashion to create a second group; and binding the first group and the second group together in a parallel fashion.

* * * * *